US005562850A

United States Patent [19]

Woo et al.

[11] Patent Number: 5,562,850

[45] Date of Patent: Oct. 8, 1996

[54] TOILET BOWL DETERGENT SYSTEM

[75] Inventors: Ricky A. Woo, Hamilton; Daniel S. Cobb, Loveland; Jeffrey L. Flora, Middletown, all of Ohio

[73] Assignee: The Procter & Gamble Company, Cincinnati, Ohio

[21] Appl. No.: 507,577

[22] Filed: Jul. 26, 1995

[51] Int. Cl.[6] ..... C11D 1/88; C11D 1/90; C11D 1/92; C11D 17/00

[52] U.S. Cl. ..... 510/151; 510/191

[58] Field of Search ..... 252/174, 174.23, 252/174.24, DIG. 16

[56] References Cited

U.S. PATENT DOCUMENTS

| | | | |
|---|---|---|---|
| 4,043,931 | 8/1977 | Jeffrey et al. | 252/93 |
| 4,269,723 | 5/1981 | Barford et al. | 252/106 |
| 4,460,490 | 7/1984 | Barford et al. | 252/92 |
| 4,722,802 | 2/1988 | Hutchings et al. | 252/174 |
| 4,911,858 | 3/1990 | Bunczk et al. | 252/106 |
| 5,061,393 | 10/1991 | Linares et al. | 252/143 |
| 5,290,472 | 3/1994 | Michael | 252/170 |
| 5,322,643 | 6/1994 | Schwartz et al. | 252/554 |
| 5,336,424 | 8/1994 | Van Vlahakis | 252/89.1 |
| 5,342,550 | 8/1994 | Burke et al. | 252/548 |

*Primary Examiner*—Paul Lieberman
*Assistant Examiner*—Gregory R. Delcotto
*Attorney, Agent, or Firm*—Robert B. Aylor

[57] ABSTRACT

Toilet bowl detergent compositions, preferably blocks of the "in-tank" or "rim-block" types, contain a cleaning system comprising: detergent surfactant of the amphoteric type, preferably zwitterionic, more preferably one that contains a carboxylate group and a cationic group, and even more preferably a fatty acid amidoalkylene betaine, and polycarboxylate chelating agent, preferably, citric acid, or similar polycarboxylic acid, are combined with some means of creating the desired concentration of the cleaning system in the toilet bowl water, preferably by means of blocks with a dissolution retarding system, preferably with the dissolution retarding system comprising a combination of water soluble cellulosic polymer, more preferably hydroxyethyl cellulose or hydroxypropyl cellulose and, polyethylene glycol containing polymer, any perfume present being selected to be mostly hydrophobic. The compositions have a pH, in use, of from about 4 to about 9 and the blocks are preferably extremely homogeneous. Processes for keeping toilet bowls clean are disclosed.

12 Claims, No Drawings

TOILET BOWL DETERGENT SYSTEM

FIELD OF THE INVENTION

This invention relates to toilet bowl cleaners, especially those of the block type that typically either sit, or hang, in the water reservoir ("tank"), or hang on the rim of a toilet bowl and rely upon the water from the "flush" to dissolve a portion of the block and wash the ingredients into the pooled water in the bowl. There is a continuing need for improved compositions of this type.

BACKGROUND OF THE INVENTION

Solid delivery systems provide effective and convenient treatment of the toilet bowl water through the use of slow dissolving blocks containing the desired cleaning ingredients. Solid blocks are extremely cost effective and typically contain materials to control dissolution. A variety of approaches have been used to control the release. The actives can be selected to have the desired limited solubility as in U.S. Pat. No. 4,820,449, Menke et al. or the actives can be incorporated into a microporous resin, as in U.S. Pat. No. 4,252,785, Isoldi.

Long-chain cellulosic polymers have been used as a major solid component to control dissolution and release of the active ingredients into the pooled water. For example, Barford et al., U.S. Pat. No. 4,269,723 teaches the use of water soluble, water dispersible clays and cellulosics to retard dissolution. Barford makes mention of chemically modified celluloses such as ethyl cellulose, methyl cellulose, sodium carboxymethyl cellulose, ethyl hydroxyethyl cellulose, and the like. Barford, et al., discloses a process for making lavatory cleansing blocks by tableting a free flowing particulate mix consisting essentially of, on a weight basis, from 5% to 90% of a surface active component and from 0.5% to 75% of one or more binders selected from clays and water soluble or water dispersible gel forming organic polymeric materials. Various optional components are also mentioned by Barford; namely, dyestuffs, perfume, water soluble fillers, water softening or chelating agents, solid water soluble acids, inert water insoluble inorganic or organic fillers, tablet lubricants, and agents having disinfecting or germicidal activity.

U.S. Pat. No. 4,460,490 to Barford, et al., discloses a freestanding lavatory cleansing block that comprises a shaped body formed of a slow dissolving cleaning composition containing a surface active agent and a tablet comprising a bleaching agent embedded in or adhered to the shaped body. The shaped body, according to the '490 patent, may be melt cast, tableted, or extruded, depending upon the geometry of the shaped body. The shaped body preferably comprises the aforesaid surface active agent and a solubility control agent, for example, a water soluble or water dispersible gel forming polymer, for example, chemically modified celluloses.

Ziek et al., U.S. Pat. No. 4,722,802, also discloses hydrated cellulosics to retard dissolution. In Ziek et al., the advantages of curing the resultant block are also discussed. Similarly, Bunczak et al., U.S. Pat. Nos. 4,911,858 and 4,911,859, disclosed very high molecular weight polyethylene oxide polymers together with guar gum and calcium salt to form a gelatin matrix that slows dissolution of the solid system.

Like Menke et al., U.S. Pat. No. 4,820,449, Jeffrey et al., U.S. Pat. No. 4,043,93 1, seeks slow dissolution through the use of mono- or di-alkanolamides of various aliphatic chain lengths while adding ethylene oxide/propylene oxide block copolymer surfactants with unspecified monomer ratios. Jeffrey, et al., discloses a lavatory cleansing block comprising a solid carrier base which is a mixture of two or more nonionic surface active agents, one of which is relatively insoluble in water and the other of which is relatively soluble in water. The lavatory block of Jeffrey may optionally include perfume, dyestuff, germicide, and fillers, the latter being for example, a water softener such as a alkali metal polyphosphate. The blocks of Jeffrey are made by tableting.

Polyethylene glycol, having a molecular weight of about 8000, is taught in U.S. Pat. No. 5,342,550, Burke et al. together with one or more fillers or binding agents for use in solid block compositions. Examples of acceptable binding agents disclosed include the water-soluble alkali metal and alkaline earth metal salts. The compositions also preferably comprise one or more additional ingredients such as, for example, cleaning agents, deodorizers or perfumes, bactericides, bacteriostats, hard water film inhibitors, stain inhibitors and dyes.

U.S. Pat. No. 4,438,015 to Huber discloses lavatory cleansing blocks comprising as a solid carrier base a mixture comprising a major proportion of a nonionic surface active compound and a minor proportion of a partially esterified copolymer of vinylmethyl ether and maleic anhydride (PVM/MA). The blocks of Huber are melt cast.

U.S. Pat. No. 4,229,410 to Kosti discloses a bacteriostatic toilet element comprising a water sensitive, water soluble or swellable binding agent and a bacteriostatic and/or deodorizing and/or coloring agent. Kosti's element may be melt cast or extruded.

As discussed above, surfactant cleansing blocks can be made by tablet forming methods, casting or extrusion as described for instance in U.S. Pat. Nos.: 4,043,931; 4,269,723; 4,460,490; 4,438,015; 4,722,802; 4,738,728; and 4,082,449. The surfactant in these cleansing blocks is released gradually over an extended period of time to clean the porcelain surface of the toilets.

Toilet bowl detergent compositions that are not blocks can also be used to form detergent solutions. There are a variety of dispensers that provide for controlled release. For example, U.S. Pat. No. 4,813.084, Buecheler et al., discloses a rim-block holder that can use granular compositions. Similarly, there are a multitude of "passive" dispensers, such as U.S. Pat. No. 4,462,121, Dirksing et al., that can use liquid or solid compositions to form the cleaning solution in the toilet tank.

SUMMARY OF THE INVENTION

This invention relates to improved cleaning systems for toilet bowls that can operate at near neutral pH. The cleaning systems are especially useful in toilet bowl block detergent compositions of the "tank" or of the "rim-block" types. Such block detergent compositions contain the cleaning system comprising: detergent surfactant of the amphoteric type, preferably zwitterionic, more preferably one that contains a carboxylate group and a cationic group, and even more preferably a fatty acid amidoalkylene betaine, and polycarboxylate chelating agent, preferably, citric acid, or similar polycarboxylic acid, together with a dissolution retarding system. For a rim-block type, the composition preferably comprises a combination of water soluble cellulosic polymer, more preferably hydroxyethyl cellulose or hydroxypropyl cellulose, having a Viscosity Grade, as defined by, e.g., Cellosize® by Union Carbide, of from about 40 to about 100,000 and, polyethylene glycol containing polymer, having a molecular weight of from about 1,000 to about 20,000, any perfume present being selected to be mostly hydrophobic. For an in-tank block, higher molecular weights are required, as disclosed hereinafter.

The compositions herein have a pH, in use, of from about 4 to about 9, preferably from about 6 to about 8. The block composition are preferably extremely homogeneous. Homogeneity can be achieved, e.g., by milling the ingredients together to provide a matrix that contains essentially no large particles of any one ingredient. Other processes that provide similar mechanical energy, especially by shearing, can also be used. Homogeneity is determined by the smoothness of the surface, including the surface of any cross section of the block after cutting.

The process herein involves using the cleaning system on a regular basis in toilet bowls, to maintain the cleanliness of the toilet bowl and prevent buildup of soil.

DETAILED DESCRIPTION OF THE INVENTION

The Cleaning System

Amphoteric, e.g., Zwitterionic Detergent Surfactants

Zwitterionic detergent surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc., can be used. A generic formula for some preferred zwitterionic detergent surfactants is:

$$R\text{-}N^{(+)}(R^2)(R^3)R^4X^{(-)}$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group wherein the group contains from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, fatty acyl amido alkylene groups are preferred.

A specific "simple" zwitterionic detergent surfactant is 3-(N-dodecyl-N,N-dimethyl)- 2-hydroxy-propane-1-sulfonate, available from the Sherex Company under the trade name "Varion HC."

Other specific zwitterionic detergent surfactants have the generic formula:

$$R\text{-}C(O)\text{-}N(R^2)\text{-}(CR^3{}_2)_n\text{-}N(R^2)_2{}^{(+)}\text{-}(CR^3{}_2)_n\text{-}SO_3{}^{(-)}$$

wherein each R is a hydrocarbon, e.g., an alkyl group containing from about 8 up to about 20, preferably up to about 18, more preferably up to about 16 carbon atoms, each ($R^2$) is either a hydrogen (when attached to the amido nitrogen), short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10-14}$ fatty acylamidopropylene(hydroxypropylene)sulfobetaine that is available from the Sherex Company under the trade name "Varion CAS Sulfobetaine".

Other zwitterionic detergent surfactants useful, and, surprisingly, preferred, herein include hydrocarbyl, e.g., fattyacylamidoalkylene betaines. These detergent surfactants, which are more cationic at the pH of the composition, have the generic formula:

$$R\text{-}C(O)\text{-}N(R^2)\text{-}(CR^3{}_2)_n\text{-}N(R^2)_2{}^{(+)}\text{-}(CR^3{}_2)_n\text{-}C(O)O^{(-)}$$

wherein each R is a hydrocarbon, e.g., an alkyl group containing from about 8 up to about 20, preferably up to about 18, more preferably up to about 16 carbon atoms, each ($R^2$) is either a hydrogen (when attached to the amido nitrogen), short chain alkyl, or substituted alkyl, containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight Chain alkyl R groups.

An example of such a detergent surfactant is a $C_{12-16}$ fatty acylamidopropylbetaine available in a preferred powder form from Goldschmidt under the trade name "Tego Betaine D."

The level of surfactant is from about 10% to about 90% by weight, preferably from about 15% to about 50% by weight, and most preferably from about 20% to about 35% by weight. At the pH of the composition in use, the carboxyl group is substantially nonionic, although some portion is ionized to create a negative charge.

The cleaning system also comprises polycarboxylic acid having strong chelating properties for calcium at the use pH, e.g., citric acid, or salt thereof, preferably sodium or potassium, or an equivalent polycarboxylic acid, or salt thereof. Equivalent polycarboxylic acids have similar calcium binding constants and include, for example, succinic, glutaric, adipic, maleic, etc. The level of polycarboxylic, e.g., citric acid, is preferably from about 10% to about 90% by weight, preferably from about 15% to about 50% by weight, and most preferably from about 20% to about 40% by weight.

The combination of amphoteric/betaine detergent surfactant and polcarboxylic/citric acid type of chelating agent provides an unusually effective cleaning effect that prolongs the time that the bowl remains clean without need for mechanical cleaning effort.

The cleaning system preferably does not include any of the solid bleaching agents, especially chlorine bleaching agents, or phosphorous containing cleaning ingredients. The materials in the composition are preferably biodegradable to the maximum extent possible and are preferably safe to use.

It is desirable that such compositions not pose a threat to pets.

The Dissolution Retarding System

The dissolution retarding system for block detergent compositions can be any one of the systems disclosed in the art, or hereafter. Preferably the dissolution system comprises water soluble cellulosic material. The primary dissolution retarding agent is preferably either hydroxypropyl cellulose or hydroxyethyl cellulose. The secondary dissolution retarding agent is preferably polyethylene glycol, or a polymer that contains a major percentage of polyethylene glycol, so that the polymer has the characteristics of polyethylene glycol. Mixtures of these agents are preferably present in the block at a level of from about 5% to about 60% by weight, and, especially for "in tank" blocks, preferably from about 10% to about 50% by weight, and most preferably from about 20% to about 40% by weight. In tank blocks require more dissolution retarding agent since they are in water for the longest time. Both of these agents are non-ionic, water soluble, acid stable polymers and have the capacity of acting as dissolution retarding agents.

For rim-block types, preferably the hydroxyethyl and/or hydroxypropyl cellulose has a Viscosity Grade, as defined in the Union Carbide publication Cellosize, of from about 40 to about 100,000, preferably from about 10,000 to about 30,000, and has a degree of hydroxyethyl or hydroxypropyl substitution of from about 0.5 to about 2.5, preferably from about 0.85 to about 1.55, and more preferably from about 0.9 to about 1. The polyethylene glycol has a molecular weight from about 1,000 to about 20,000, preferably form about 2,000 to about 8,000.

For in-tank block types, preferably higher molecular weights are preferred. Typically, the cellulosic polymers are those that have a Brookfield viscosity at 25° C and at 1% concentration in water of from about 1,000 to about 5,000, e.g., Natrosol® brand grades of from MH to HH, available from Hercules, Inc. Similarly, the other polymer is poly-(ethylene oxide) which has a molecular weight of from about $2\times10^5$ to about $5\times10^6$ preferably from about $1\times10^6$ to about $5\times10^6$, e.g., Polyox® WSR-301 or Polyox Coagulant from Union Carbide.

The ratio of cellulosic material to polyethylene glycol (or their equivalents) is from about 0.1% to about 0% preferably from about 0.5% to about 30, more preferably from about 1 to about 10.

The blocks contain relatively high levels of perfumes to impart an acceptable odor to the composition and subsequently to the treated water, and may include essential oils and pine extracts, terpinolenes, bornyl acetate, etc., as well as others known in the art. The level of perfume is preferably from about 0.1% to about 20%, preferably from about 1% to about 15, more preferably from about 3% to about 8%. These high levels of perfume can drastically affect the dissolution rate. Preferably, the perfume that is present should be relatively hydrophobic, especially in rim-block compositions, to avoid increasing the dissolution rate and the block should be homogeneous, as disclosed before, in order to minimize the presence of holes in the block and of water soluble areas that dissolve to create holes in the block.

Other dissolution retarding agents can be present. Other dissolution retarding agent modifiers include water dispersible, acid stable polyalkoxylated cetyl alcohol or stearyl alcohol, or a mixture thereof, containing from about 2 to about 8 alkyleneoxy units per molecule, preferably from about 4 to about 6 units, and having a molecular weight of from about 360 to about 650. The alkyleneoxy units are preferably ethyleneoxy. The level of dissolution is controlled to provide a level of cleaning actives (cleaning system ingredients) in the toilet bowl water of from about 1 ppm to about 1000 ppm, preferably from about 5 ppm to about 50 ppm, more preferably from about 10 ppm to about 30 ppm, the ratio of detergent surfactant to polycarboxylic acid being from about 1:100 to about 100:1, preferably from about 1:10 to about 10: 1, and more preferably from about 1:3 to about 3:1.

The rate of dissolution for block detergent compositions can be adjusted by incorporating larger or smaller amounts of the various dissolution retarding agents to provide lesser and greater rates of dissolution. For example, for any given hanger that holds the block, and for any given type of toilet which; has a given flow of water, there will be an optimum dissolution rate. In general, the cellulosic material will provide the greatest resistance to dissolution. The polyethylene glycol will provide less resistance, and the perfume selection and homogeneity will affect the dissolution rate. Within the limits given herein before, one can adjust the dissolution system based upon the level of cleaning system actives, the surface area of the block that is exposed to the water flow by the hanger, the type and level of perfume present, and the desired level of cleaning ingredients in the bowl water. By adjusting the amounts and identities of erosion rate modifiers, the dissolution rate can be readily adjusted to create the desired level of cleaning ingredients in the bowl. The life of the block can be varied from about one to about five months by adjusting the size of the block.

Optional Ingredients

The composition according to the invention can also, preferably, comprise one or more additional ingredients such as, for example, bactericides, bacteriostats, hard water film inhibitors, stain inhibitors and dyes. These additional ingredients can be present in the composition in total amounts of from about 0.1% to about 20% by weight, preferably about 1% to about 15% by weight and most preferably about 3% to about 10% by weight of the composition.

Bactericides and bacteriostats are those agents which inhibit and kill germs and other undesirable organisms. These may include, for example, quaternary ammonium materials, oxygen bleaches like monopersulfates (typically potassium salts), etc. as well as others known to those skilled in the art. In general, however, these are not needed in the present invention.

Hard water inhibitors and stain inhibitors may include polymers such as sodium polyacrylates or copolymers of maleic and acrylic acids.

Dyes are those ingredients which typically impart a pleasing color to the composition, and can include any of the known blue, green or violet dyes.

Process for Manufacture

Although the solid block, controlled release compositions herein can be prepared by any known process, such as casting, molding or tablet compression, the compositions are preferably prepared by imparting mechanical energy and shearing forces to the composition, e.g., by milling the various ingredients, to effect a highly homogeneous mass and then extruding the mass. The extruded shape is then cut into convenient sizes, stamped, if desired, and packaged, preferably in association with a "hanger" that keeps the block in position where the water can erode the block and effect release of the cleaning system. Preferably, there should not be any large areas of water soluble ingredients in the block. As discussed herein before, the desired degree of uniformity will be accompanied by a smooth appearance of the surface, and of any cross section that is cut. The blocks of the invention can be molded into numerous shapes and sizes, but it is preferable that the blocks range in weight of from about 40 to about 120 grams to provide a life of from about four weeks to about four months.

All percentages, parts, and ratios herein are "by weight" unless otherwise stated and all numbers are approximations to account for normal variations in measurements.

The invention is illustrated by the following non limiting Examples.

Toilet Rim-Block Compositions

| Component | EXAMPLE 1 Wt. % | 2 Wt. % | 3 Wt. % | 4 Wt. % |
|---|---|---|---|---|
| Cocoamidopropylbetaine* | 21 | 25 | 17 | 25 |
| Sodium Citrate | 25 | 30 | 20 | 32 |
| Perfume (Hydrophobic) | 6 | 5 | 7 | 5 |
| Polyethylene Glycol (MW-8000) | 25 | 32 | 20 | 20 |
| Hydroxyethylcellulose (VG-40) | — | 5 | — | — |
| Hydroxyethylcellulose (VG-30,000) | 20 | — | 35 | — |
| Hydroxyethylcellulose (VG-100,00) | — | — | — | 15 |
| Blue Dye (0.45% solution) | 1 | 0 | 0 | — |
| Soft Water | 2 | 3 | 1 | 3 |
| Total | 100 | 100 | 100 | 100 |

*$C_{12-16}$ fatty acylamidopropylbetaine from Goldschmidt (Tego Betaine D).

Toilet In-Tank Block Compositions

| Component | EXAMPLE 1 Wt. % | 2 Wt. % | 3 Wt. % | 4 Wt. % |
|---|---|---|---|---|
| Cocoamidopropylbetaine* | 29 | 26 | 23 | 24 |
| Sodium Citrate | 27 | 27 | 27 | 27 |
| Perfume (Hydrophobic) | 1 | 1 | 1 | 1 |
| Hydroxyethylcellulose (Hercules Natrosol 250-HHX) | 9 | 18 | 27 | 27 |
| Polyox WSR ® Coagulant (Union Carbide) | 27 | 18 | 9 | 9 |
| Blue Dye (0.45% solution) | 1 | 1 | 1 | 1 |
| Soft Water | 6 | 9 | 12 | 9 |
| Total | 100 | 100 | 100 | 100 |

*$C_{12-16}$ fatty acylamidopropylbetaine from Goldschmidt (Tego Betaine D).

What is claimed is:

1. A block detergent composition for keeping a toilet bowl clean comprising:

(1) a cleaning system comprising: from about 10% to about 90% of detergent surfactant of the amphoteric type wherein said detergent surfactant has the formula:

$$R\text{-}C(O)\text{-}N(R^2)\text{-}(CR^3{}_2)_n\text{-}N(R^2)_2{}^{(+)}\text{-}(CR^3{}_2)_n\text{-}C(O)O^{(-)}$$

wherein each R is a hydrocarbon group containing from about 8 to about 20 carbon atoms, each ($R^2$) is either hydrogen when ($R^2$) is attached to the amido nitrogen, or short chain alkyl or substituted alkyl containing from one to about four carbon atoms, each ($R^3$) is selected from the group consisting of hydrogen and hydroxy groups, and each n is a number from 1 to about 4, with no more than about one hydroxy group in any ($CR^3{}_2$) moiety and from about 10% to about 90% of polycarboxylate chelating agent; and (2) system for providing a concentration of from about 1 ppm to about 1000 ppm of said detergent surfactant and said chelating agent in the water of said toilet bowl, said system being a dissolution retarding system which comprises a mixture of (1) cellulosic material that is selected from the group consisting of hydroxypropyl cellulose, hydroxyethyl cellulose, and mixtures thereof, and (2) polyethylene glycol, or a polymer that contains a major percentage of polyethylene glycol, so that the polymer has the characteristics of polyethylene glycol, the ratio of (1) to (2) being from about 0.5 to about 30 said mixture being at a level of from about 5% to about 60% by weight of said composition said water in said toilet bowl having a pH of from about 6 to about 8.

2. The composition of claim 1 wherein the level of surfactant is from about 15% to about 50% by weight.

3. The composition of claim 1 wherein the level of surfactant is from about 20% to about 40% by weight.

4. The composition of claim 1 wherein said polycarboxylic acid is selected from the group consisting of: citric acid; succinic acid, glutaric acid, adipic acid, maleic acid; mixtures thereof, or salt thereof.

5. The composition of claim 4 wherein said polycarboxilic acid is citric acid.

6. The composition of claim 5 wherein the level of said polycarboxylic acid is from about 15% to about 50% by weight.

7. The composition of claim 5 wherein the level of said polycarboxylic acid is from about 20% to about 40% by weight.

8. The composition of claim 7 wherein said dissolution retarding system is at a level of from about 10% to about 50% by weight, the hydroxyethyl and/or hydroxypropyl cellulose has a Viscosity Grade, as defined in the Union Carbide publication Cellosize, of from about 40 to about 100,000 and a degree of hydroxyethyl or hydroxypropyl substitution of from about 0.5 to about 2.5, and the polyethylene glycol has a molecular weight from about 1,000 to about 20,000.

9. The composition of claim 7 wherein said dissolution retarding system is at a level of from about 20% to about 40% by weight, the hydroxyethyl and/or hydroxypropyl cellulose has a Viscosity Grade, as defined in the Union Carbide publication Cellosize, of from about 10,000 to about 30,000, and a degree of hydroxyethyl or hydroxypropyl substitution of from about 0.85 to about 1.55, and the polyethylene glycol has a molecular weight from about 2,000 to about 80,000.

10. The composition of claim 7 wherein said dissolution retarding system is at a level of from about 10% to about 50% by weight, the hydroxyethyl and/or hydroxypropyl cellulose has a Brookfield viscosity at 25° C. and at 1% concentration in water of from about 1,000 to about 5,000, and a degree of hydroxyethyl or hydroxypropyl substitution of from about 0.5 to about 2.5, and the poly(ethylene oxide) has a molecular weight from about $2\times10^5$ to about $5\times10^6$.

11. The composition of claim 10 wherein said dissolution retarding system is at a level of from about 20% to about 40% by weight and the poly(ethylene oxide) has a molecular weight from about $1\times10^6$ to about $5\times10^6$.

12. The block detergent composition of claim 1 wherein said composition is made by imparting mechanical energy and shearing forces to the composition to effect a highly homogeneous mass and then extruding the mass.

* * * * *